US009134652B2

(12) United States Patent
Tanaka et al.

(10) Patent No.: US 9,134,652 B2
(45) Date of Patent: Sep. 15, 2015

(54) DEVELOPING DEVICE AND IMAGE FORMING APPARATUS

(75) Inventors: Masanori Tanaka, Yokohama (JP); Motoki Adachi, Ashigarakami-gun (JP); Kentaro Kawata, Suntou-gun (JP); Takayuki Kanazawa, Yokohama (JP); Shunsuke Mizukoshi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 12 days.

(21) Appl. No.: 13/584,019

(22) Filed: Aug. 13, 2012

(65) Prior Publication Data

US 2013/0045030 A1 Feb. 21, 2013

(30) Foreign Application Priority Data

Aug. 15, 2011 (JP) ..... 2011-177405

(51) Int. Cl.

*G03G 15/00* (2006.01)
*G03G 15/08* (2006.01)
*G03G 21/16* (2006.01)
*G03G 21/18* (2006.01)

(52) U.S. Cl.

CPC ..... *G03G 15/0896* (2013.01); *G03G 21/1647* (2013.01); *G03G 21/181* (2013.01)

(58) Field of Classification Search

CPC ... G03G 13/06; G03G 15/06; G03G 15/0822; G03G 15/0834; G03G 15/0865; G03G 15/0896; G03G 15/0877; G03G 2215/06; G03G 2215/0634; G03G 2215/0636; G03G 2215/08

USPC ..... 399/102, 103, 104, 106, 107, 111, 119, 399/120, 227, 258, 259, 260, 261, 262, 263, 399/265, 281

See application file for complete search history.

(56) References Cited

U.S. PATENT DOCUMENTS

| | | | | |
|---|---|---|---|---|
| 6,009,289 | A * | 12/1999 | Sekine et al. | 399/113 |
| 2007/0147863 | A1* | 6/2007 | Takahashi | 399/49 |
| 2008/0317513 | A1* | 12/2008 | Sakagawa et al. | 399/281 |
| 2010/0054823 | A1* | 3/2010 | Takasaka et al. | 399/286 |
| 2011/0211867 | A1* | 9/2011 | Hashimoto et al. | 399/119 |

(Continued)

FOREIGN PATENT DOCUMENTS

| | | | |
|---|---|---|---|
| JP | 7-181786 | A | 7/1995 |
| JP | 2001-255729 | A | 9/2001 |

(Continued)

*Primary Examiner* — Benjamin Schmitt
*Assistant Examiner* — Matthew Miller
(74) *Attorney, Agent, or Firm* — Fitzpatrick, Cella, Harper & Scinto

(57) ABSTRACT

A developing device includes a developer carrying member, rotatable while carrying a developer, for supplying developer to an image bearing member, a developer supplying member, which is provided with a foam layer at its surface and is rotatable in contact with the developer carrying member, for supplying the developer to the developer carrying member, and a first gear for transmitting a driving force to the developer supplying member. The first gear is movable to a first position where the driving force is not transmitted to the developer supplying member and to a second position where the driving force is transmitted to the developer supplying member. During initial drive of the developer carrying member, the developer supplying member is rotated by a frictional force generated between the developer supplying member and the developer carrying member, with the first gear to be moved from the first position to the second position.

14 Claims, 9 Drawing Sheets

(56) References Cited

U.S. PATENT DOCUMENTS

2012/0195634 A1* 8/2012 Kuriki ..... 399/119
2015/0003868 A1* 1/2015 Shimizu et al. ..... 399/119

FOREIGN PATENT DOCUMENTS

JP 2001255729 A * 9/2001
JP 2010-157000 A 7/2010

* cited by examiner (a)

(b)

(a)

(b)

DEVELOPING DEVICE AND IMAGE FORMING APPARATUS

FIELD OF THE INVENTION AND RELATED ART

The present invention relates to a developing device including a supplying member for supplying a toner to a developer carrying member and relates to an image forming apparatus including the developing device.

The developing device used in the image forming apparatus of an electrophotographic type generally includes a developing roller for developing an electrostatic latent image on an image bearing member and includes a supplying roller for supplying a developer (toner) to the developing roller.

Generally, as the supplying roller, a sponge-like roller provided with many pores (foam cell) is used and is contacted to the developing roller, while rotating in a direction opposite to a rotational direction of the developing roller, in order to positively supply the toner to the developing roller (Japanese Laid-Open Patent Application (JP-A) Hei 07-181786).

In recent years, downsizing of the image forming apparatus is advanced, so that a large space is not required and the image forming apparatus can take various attitudes during transportation. As a result, in many cases, the image forming apparatus is transported in a state different from an original disposition attitude. Here, during the transportation, there is the case where the image forming apparatus is transported via an unpaved bad road and the case where the image forming apparatus is adversely affected by vibration while being disposed with various attitudes.

In the image forming apparatus including a developing device provided with no toner seal, the toner is present at a periphery of the supplying roller in a brand-new state. Here, in such a situation, a toner supplying member was excessively clogged with the toner by the vibration during the transportation and thus a driving torque of the supplying roller was increased during use, so that excessive load was exerted on the supplying roller in some cases.

Next, the excessive clogging of the supplying roller with the toner in the brand-new state will be specifically described. Parts (a) and (b) of FIG. 9 are schematic views for illustrating a problem of a conventional toner supplying portion, in which (a) is a sectional view in the neighborhood of core metals of the supplying roller and the developing roller, and (b) is a schematic view showing a contact state between the supplying roller and the developing roller.

In FIG. 9, during transportation, a supplying roller 124 (developer supplying member) and a developing roller 125 are in a contact state. The supplying roller 124 includes an electroconductive core metal 128 as its rotation shaft, and the developing roller 125 includes an electroconductive core metal 129 as its rotation shaft.

The excessive clogging of the supplying roller 124 with the toner is particularly liable to occur by a phenomenon that a distance between the supplying roller 124 and an inner wall of a developing container 121 with respect to a longitudinal direction of the supplying roller 124 is short and the distance between the end surface of the supplying roller 124 and the inner wall of the developing container 121 is changed by vibration.

Part (a) of FIG. 9 shows a state in which the image forming apparatus main assembly is vertically disposed and thus the supplying roller 124 is disposed in a direction perpendicular to the ground. Here, the supplying roller 124 has play with respect to the longitudinal direction. For this reason, when the image forming apparatus vibrates in the vertical direction (arrow direction in the figure) during transportation, the distance between the end surface of the supplying roller 124 and the wall of the developing container 121 is changed.

Here, a toner 112 accumulated by gravitation in the neighborhood of the wall of the developing container 121 in a lower end side of the supplying roller 124 enters the supplying roller 124 from the end surface of the supplying roller 124 (upward arrows in the figure). For this reason, the toner 112 is closely incorporated in the supplying roller 124 and thus enters the supplying roller 124 to reach the neighborhood of the electroconductive core metal 128.

On the other hand, at a contacting nip 124*b* between the developing roller 125 and the supplying roller 124, the supplying roller 124 is compressed, so that an entering amount of the toner 112 is smaller than that at a portion 124*a* other than the contact nip 124*b*. Therefore, a toner content is different between the contact nip 124*b* and the portion 124*a* other than the contact nip 124*b*, so that hardness non-uniformity is generated with respect to a circumferential direction of the supplying roller 124. As a result, at the portion 124*a* other than the contact nip 124*b*, apparent hardness of the supplying roller 124 is increased and thus a driving torque is increased.

Further, the sponge layer of the supplying roller 124 is, due to the increase in hardness, in a state in which the supplying roller 124 is not readily rotated. In this state, when the electroconductive core metal 128, as a driving force inputting portion, of the supplying roller 124 is rotated during initial drive of the supplying roller 124, a twisting force acts between the electroconductive core metal 128 and the sponge layer. As a result, an excessive load is exerted on the inside of the supplying roller 124.

SUMMARY OF THE INVENTION

A principal object of the present invention is to suppress a load exerted on a developer supplying member during initial drive.

According to an aspect of the present invention, there is provided a developing device comprising: a developer carrying member, rotatable while carrying a developer, for supplying the developer to an image bearing member; a developer supplying member, which is provided with a foam layer at its surface and is rotatable in contact to the developer carrying member, for supplying the developer to the developer carrying member; a first gear for transmitting a driving force to the developer supplying member; and a pressing member for pressing the first gear so that the first gear is, during initial drive of the developer carrying member, moved from a first position where the driving force is not transmitted to the developer supplying member to a second position where the driving force is transmitted to the developer supplying member.

By employing the above constitution, it is possible to suppress the load exerted on the developer supplying member during initial drive.

These and other objects, features and advantages of the present invention will become more apparent upon a consideration of the following description of the preferred embodiments of the present invention taken in conjunction with the accompanying drawings.

Figure 4:
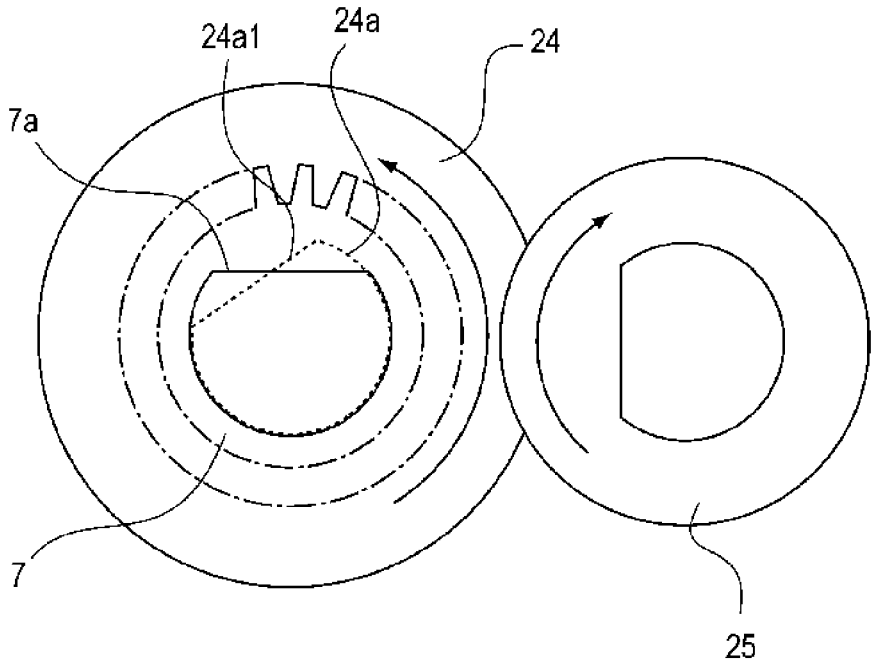
Figure 4:
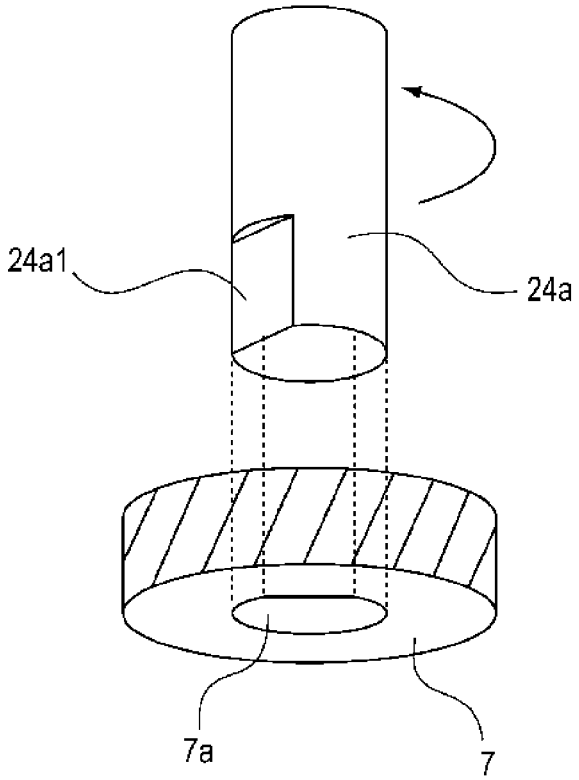

Parts (a) and (b) of FIG. 4 are schematic illustrations showing a state of a driving portion in an initial stage in the embodiment.

Figure 5:
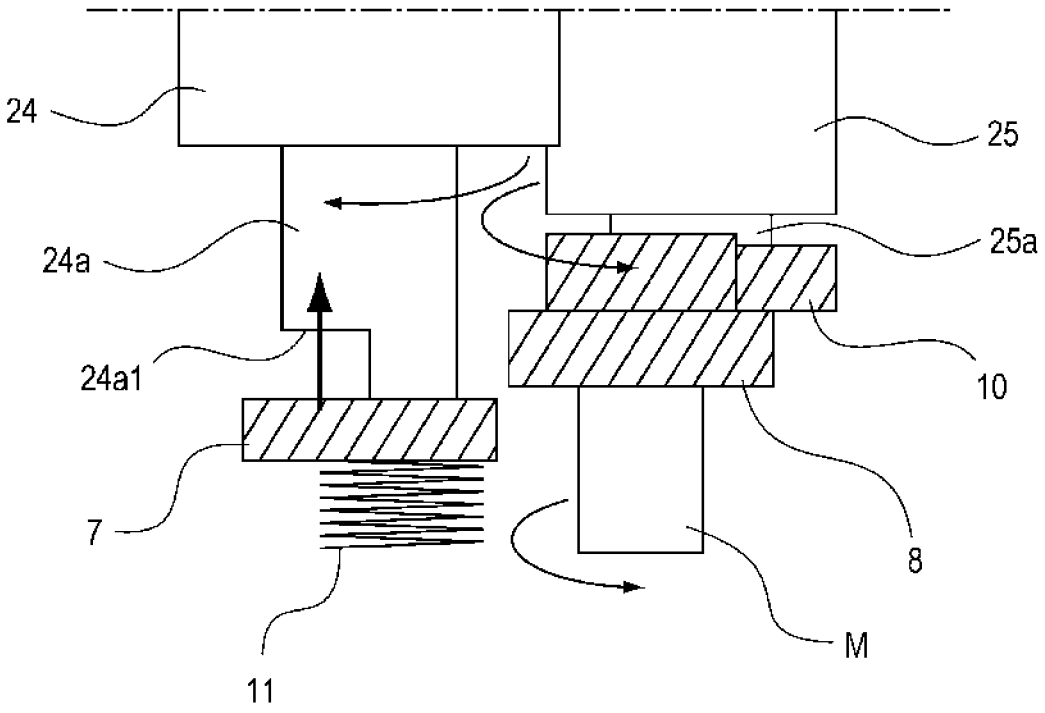

FIG. 5 is a schematic illustration of drive in the initial stage in the embodiment.

Figure 6:
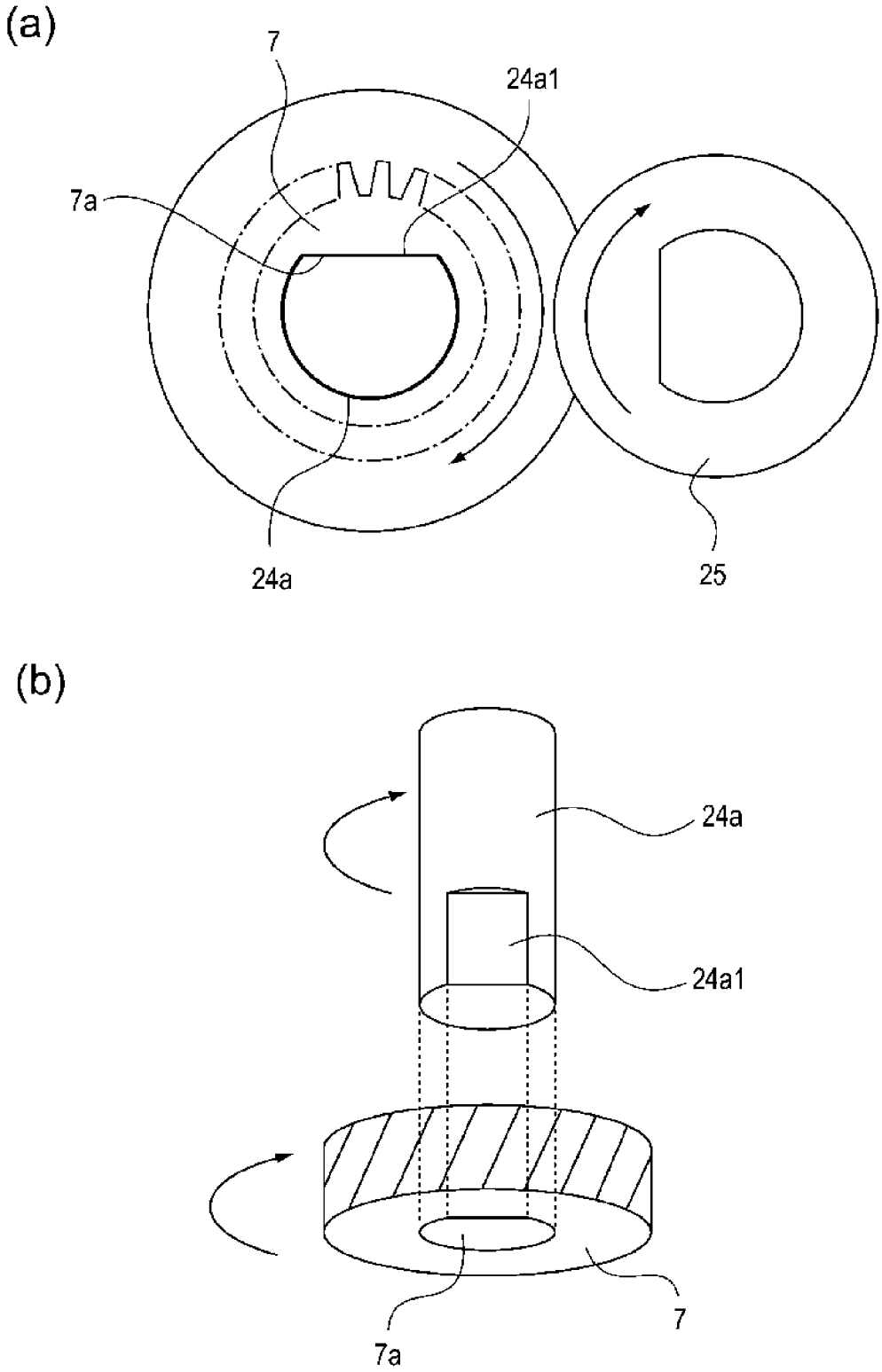

Parts (a) and (b) of FIG. 6 are schematic illustration showing a state of the driving portion during engagement in the embodiment.

Figure 7:
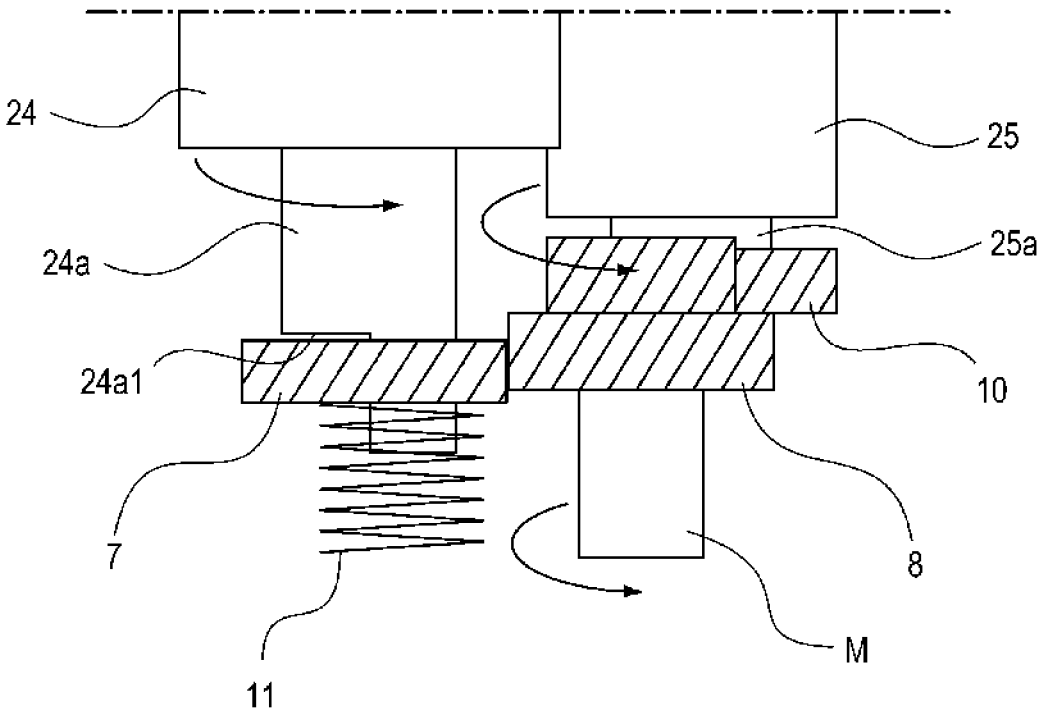

FIG. 7 is a schematic illustration of drive during engagement in the embodiment.

Figure 8:
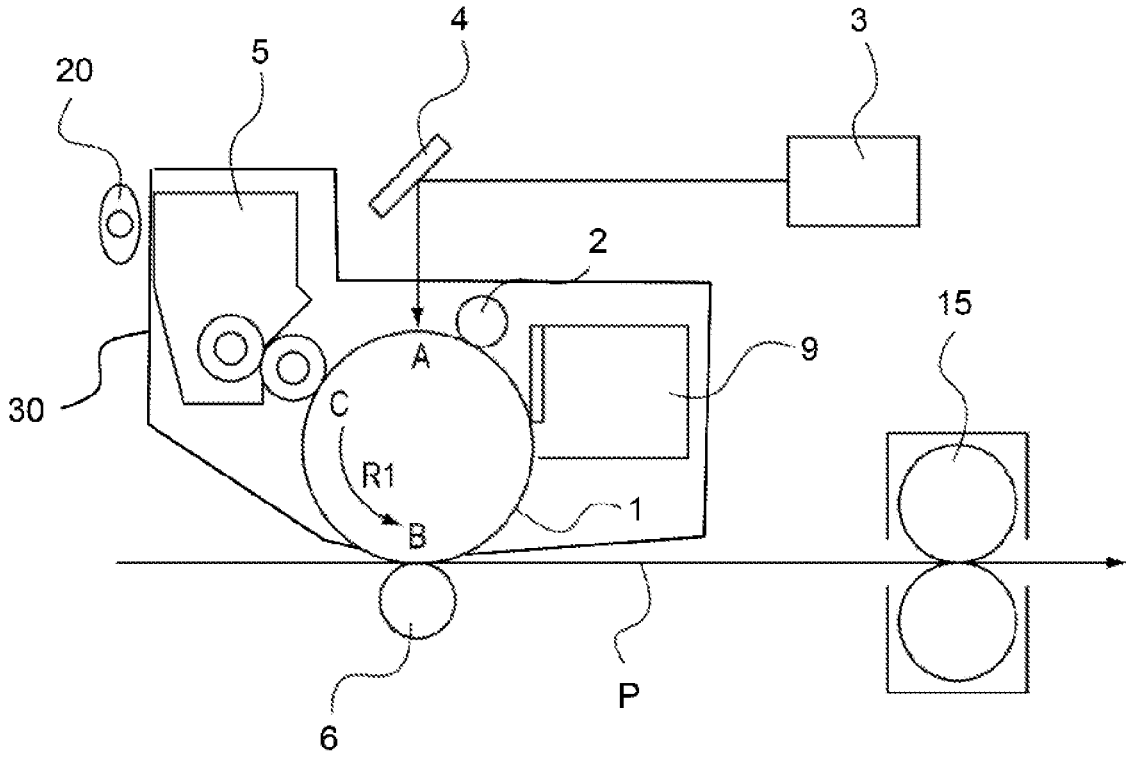

FIG. 8 is a schematic illustration showing an example of an image forming apparatus to another embodiment of the present invention.

Figure 9:
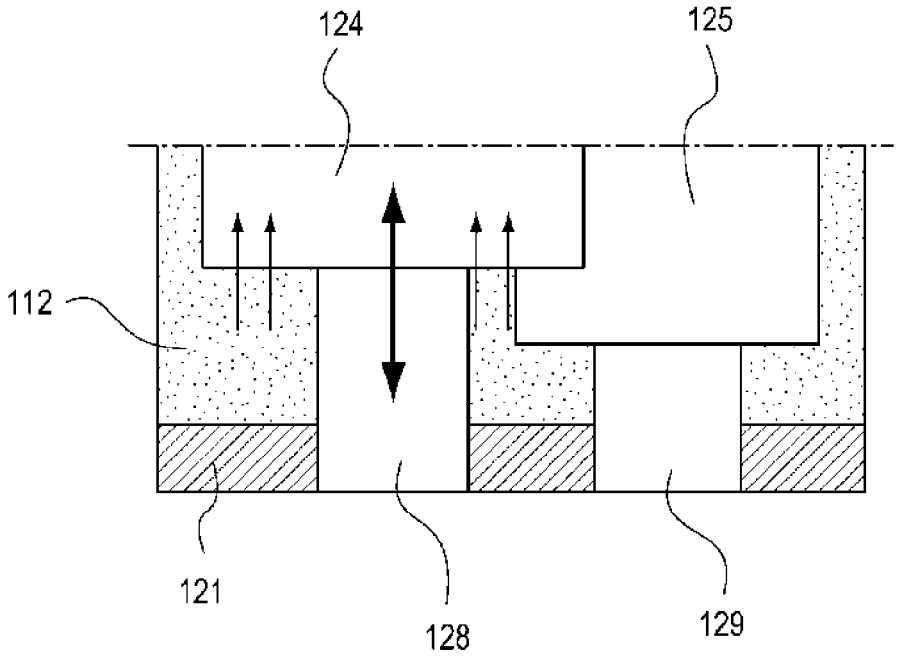
Figure 9:
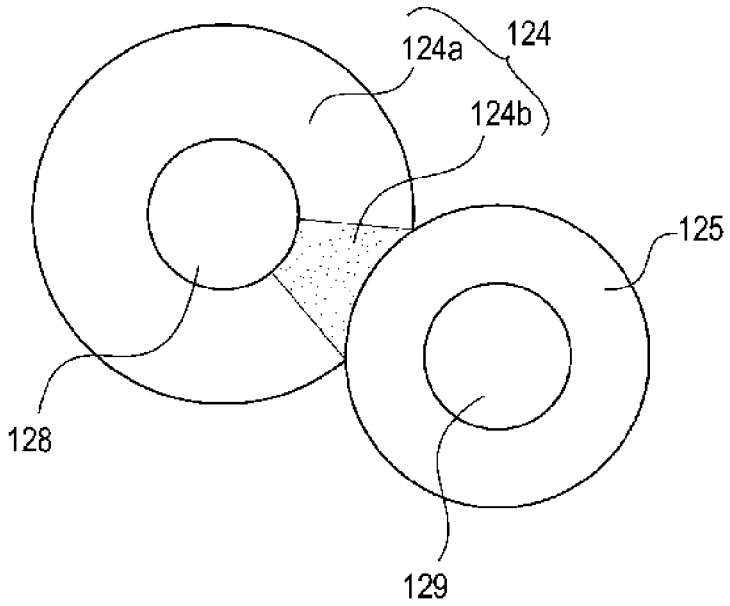

Parts (a) and (b) of FIG. 9 are schematic views for illustrating a problem at a conventional toner supplying portion.

DESCRIPTION OF THE PREFERRED EMBODIMENTS

Hereinabove, embodiments for carrying out the present invention will be specifically described with reference to the drawings. However, dimensions, materials, shaped, relative arrangements and the like of constituent elements described in the following embodiments should be appropriately modified depending on constitutions and various conditions of image forming apparatuses to which the present invention is applied. Therefore, the scope of the present invention is not limited to the following embodiments.

(Image Forming Apparatus)

Figure 1:
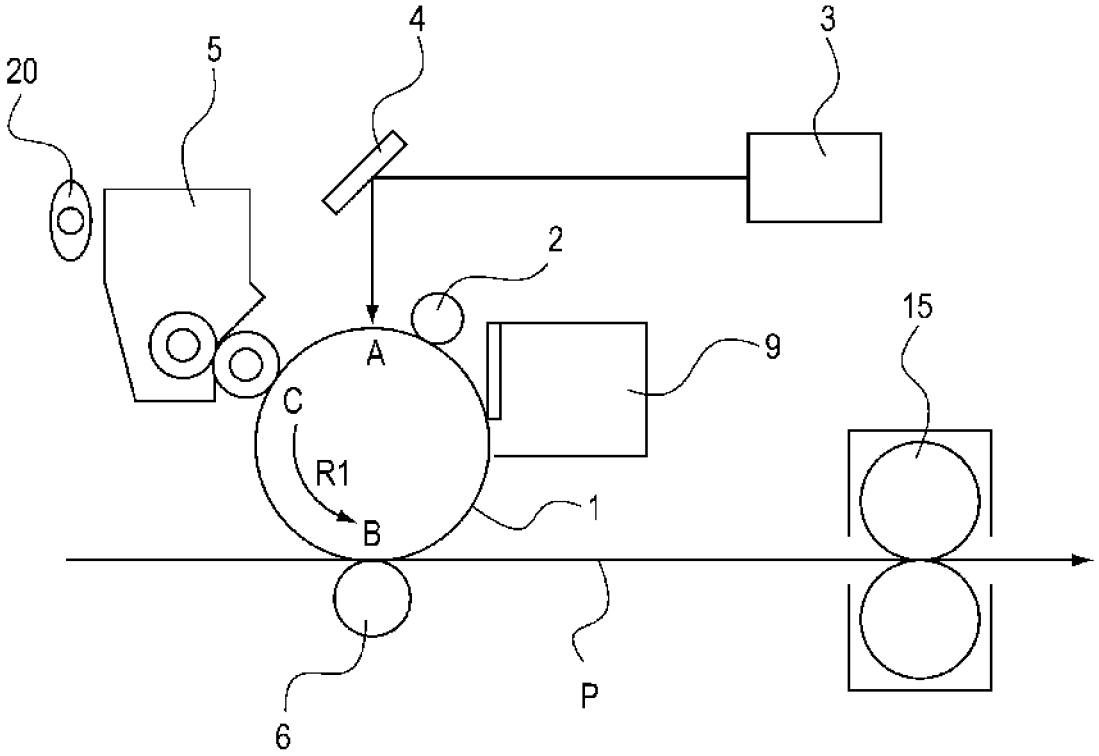
FIG. 1 is a schematic illustration showing an example of an image forming apparatus according to an embodiment of the present invention.

A general structure of an image forming apparatus according to the present invention will be described with reference to FIG. 1. FIG. 1 is a schematic illustration showing an example of the image forming apparatus in this embodiment.

As shown in FIG. 1, the image forming apparatus includes a photosensitive drum 1 (image bearing member). Around the photosensitive drum 1, process means such as a charging roller 2, an exposure device 3 and a developing device 5 (developing means) re are provided.

B this constitution, in a state in which the photosensitive drum 1 rotates in an arrow R1 direction in FIG. 1 at 100 mm/sec, the surface of the photosensitive drum 1 is electrically charged to a predetermined potential by the charging roller 2. In this state, a laser beam emitted from the exposure device 3 reaches an exposure position A of the photosensitive drum 1 via reflection mirror 4 depending on an image signal for each color. As a result, on the photosensitive drum 1, an electrostatic latent image is formed by the laser beam.

To this electrostatic latent image, a toner (developer) contained in the developing device 5 is supplied at a developing position C of the develop 1. As a result, a toner image is formed on the photosensitive drum 1. Incidentally, the developing device 5 has a cartridge form, thus being constituted so as to be detachably mountable to the main assembly of the image forming apparatus. Thus, the developing device 5 is exchangeable during consumption of the toner contained therein.

Below the photosensitive drum 1, a transfer roller 6 is provided, and a fixing device 15 is provided downstream of the transfer roller 6 with respect to a conveyance direction of a transfer material P.

By this constitution, the toner image formed on the photosensitive drum 1 as described above is transferred onto the transfer material P at a transfer position B by the transfer roller 6, and then is sent to the fixing device 15. In the fixing device 15, when the transfer material P is pressed and heated, the toner image is fixed on the transfer material P to provide a final image.

Incidentally, a cleaning device 9 is provided downstream of the transfer position B, where the transfer roller 6 opposes the photosensitive drum 1, with respect to a movement direction of the photosensitive drum 1. A blade of the cleaning device 9 scrapes off the toner from the photosensitive drum 1.

Thus, the surface of the photosensitive drum after the toner image transfer is cleaned.

(Developing Device)

Figure 2:
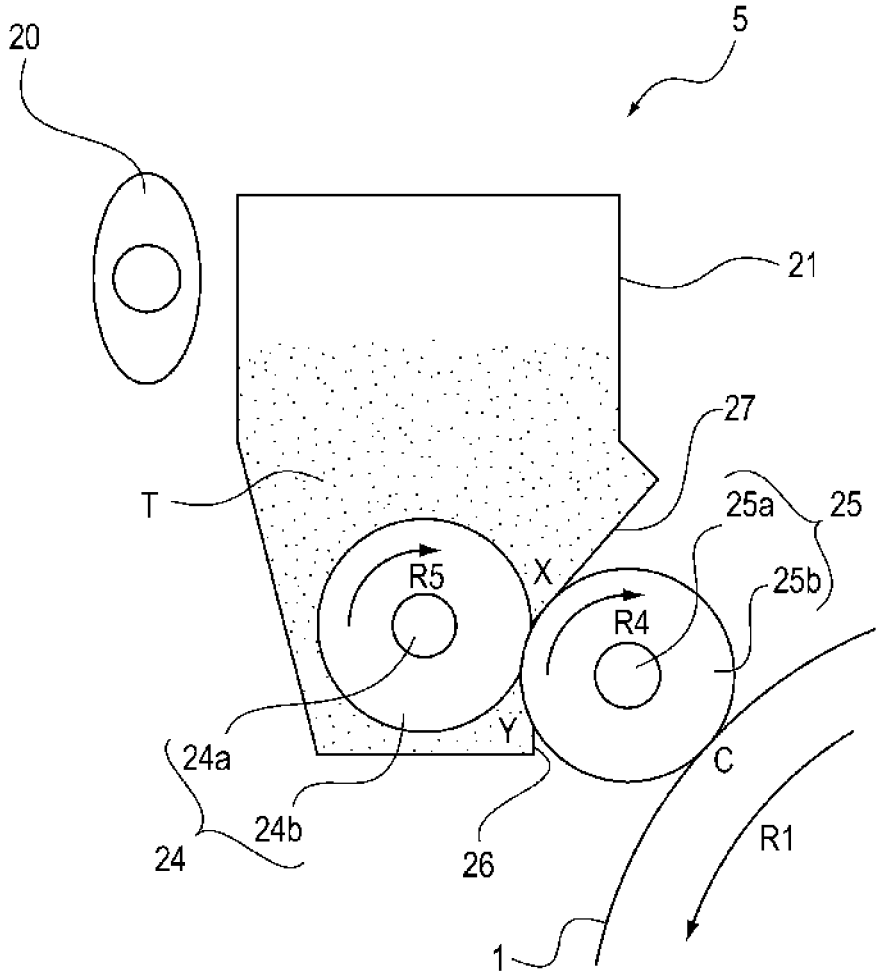
FIG. 2 is a schematic illustration of a developing device according to the embodiment.

With reference to FIG. 2, the developing device 5 will be specifically described. FIG. 2 is a schematic illustration of the developing device in this embodiment.

As shown in FIG. 2, the developing device 5 includes a developing container 21 for accommodating the toner and a developing roller 25 (developer carrying member) provided at an opening of the developing container 21. Further, the developing device 5 includes a regulating blade 27 and a supplying roller 24 (developer supplying member) provided adjacently to the developing roller 25 inside the developing container 21. Further, in a brand-new state, a toner seal for separating the toner from these members is not provided.

By the above-described constitution, the developing roller 25 rotates in a contact state to the photosensitive drum 1 during a developing operation. To the developing roller 25 and the supplying roller 24, a driving force is transmitted from a driving force inputting gear 8 (FIG. 5). For this reason, the supplying roller 24 and the developing roller 25 start and stop their rotations with the same timing.

As shown in FIG. 2, the supplying roller 24 and the developing roller 25 are rotated in the same direction (the clockwise direction). In this constitution, at a contact surface between the supplying roller 24 and the developing roller 25, these rollers are moved in opposite directions (counter directions). For this reason, the contact nip between the supplying roller 24 and the developing roller 25 is in a state in which a frictional force is high.

After the end of the developing operation, a cam 20 provided to the main assembly of the image forming apparatus is rotated. Then, when an end of the cam 20 pushes an upper portion of the developing container 21, the developing roller 25 is separated from the photosensitive drum 1. After the separation of the developing roller 25 from the photosensitive drum 1, the rotational drive of the supplying roller 24 and the developing roller 25 is stopped by stopping the driving device.

The developing roller 25 in this embodiment is constituted by an electroconductive core metal 25*a* (rotation shaft) of 8 mm in diameter and an electroconductive elastic layer 25*b*, formed on a peripheral surface of the core metal 25*a*, using a silicone rubber as a base layer. The surface layer of the elastic layer 25*b* is coated with an acrylic urethane rubber layer. The developing roller 25 is 13 mm in outer diameter and is about $10^5$ Ω·cm in volume resistivity.

As shown in FIG. 2, the developing roller 25 during the developing operation is contacted to the photosensitive drum 1 at the developing position C and is supported by the developing container 21 so as to be rotationally driven in an arrow R4 direction in FIG. 2. A rotational speed (peripheral speed) of the developing roller 25 is 160 mm/sec.

The supplying roller 24 is constituted by an electroconductive core metal 24*a* (rotation shaft) of 6 mm in diameter and an urethane sponge layer 24*b* (foam surface layer), formed on the peripheral surface of the core metal 24*a*, of a soft opencell foam. The supplying roller 24 is 15 mm in outer diameter and is about $10^8$ Ω·cm in volume resistivity.

In this embodiment, a distance between the center of the core metal 25*a* of the developing roller 25 and the center of the core metal 24*a* of the supplying roller 24 (hereinafter referred to as a center distance) is 13 mm. Further, the developing roller 25 and the supplying roller 24 are disposed so that the surface of the developing roller 25 presses the urethane sponge layer 24*b* of the supplying roller 24 with a penetration depth (entering amount) of about 1 mm. Here, the penetration depth is a length, on a line segment connecting the centers of the core metal 25*a* and the core metal 24*a*, obtained by subtracting the center distance from ½ of the sum of the outer diameters of the developing roller 25 and the supplying roller 24.

The supplying roller 24 is supported by the developing container 21 so as to be rotationally driven in an arrow R5 direction in FIG. 2. During image formation, a rotational speed (peripheral speed) of the supplying roller 24 is 140 mm/sec.

The regulating blade 27 is formed of a flexible phosphor bronze plate. An end of the regulating blade 27 is fixed to the developing container 2 and the other end is contacted, as a free end, to the developing roller 25. The regulating blade 27 is disposed so that a smooth surface in the neighborhood of the free end slides on the surface of the developing roller 25 in a direction in which it opposes the rotational direction of the developing roller 25. Further, a leakage-preventing seal 26 for covering a gap between the developing roller 25 and the supplying roller 24 is provided.

Here, a behavior of the toner dispersed in the urethane sponge layer of the supplying roller 24 and in ambient air of the sponge layer when the supplying roller 24 and the developing roller 25 are rotated at the predetermined speeds, respectively, will be described.

In a region (in the neighborhood of X in FIG. 2) upstream of the contact position between the supplying roller 24 and the developing roller 25 with respect to the rotational direction of the supplying roller 24, the supplying roller 24 is compressed. Thus, in the neighborhood of X, the supplying roller 24 is compressed and therefore, the toner absorbed in the supplying roller 24 is discharged together with the air.

On the other hand, in a region (in the neighborhood of Y in FIG. 2) downstream of the contact with respect to the rotational direction of the supplying roller 24, the supplying roller 24 is released from the compression state. In the neighborhood of Y, when the state of the supplying roller 24 is released from the compression state and is returned to an original state, the toner dispersed in the air is absorbed into the urethane sponge layer 24*b* of the supplying roller 24. In this case, in a conventional constitution, the problem as described above arose.

Therefore, in this embodiment, in order to prevent the load on the supplying roller 24 during an initial operation, a method for discharging the toner excessively clogging the supplying roller 24 without exerting the load on the supplying roller 24 has been found and is employed. Specifically, as described below, only during an initial operation, the developing roller 24 is rotated by the rotation of the developing roller 25.

(Supplying Roller and Supplying Roller Driving Gear)

Figure 3:
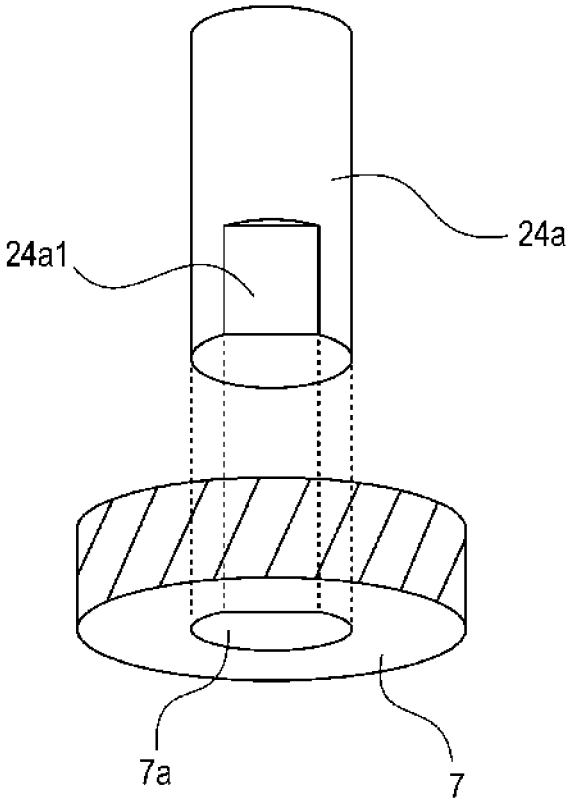
FIG. 3 is a schematic illustration of a supplying roller and a driving gear in the embodiment.

A constitution, as a feature of the present invention, of the supplying roller 24 and a supplying roller driving gear 7 in this embodiment will be described with reference to FIG. 3. FIG. 3 is a schematic illustration of the supplying roller 24 and the supplying roller driving gear 7 in this embodiment.

As shown in FIG. 3, the supplying roller 24 and the supplying roller driving gear 7 (developer supplying member driving gear) are engageably constituted. Specifically, the core metal 24*a* is provided with a cut-away portion 24*a*1 at its end portion as shown in FIG. 3, and on the other hand, the supplying roller driving gear 7 is provided with an engaging hole 7*a*. Further, by engagement between the supplying roller driving gear 7 and the driving force inputting gear 8 (described later), the driving force is transmitted to the supplying roller 24.

Next, a method for achieving this embodiment will be described with reference to FIG. 4. Parts (a) and (b) of FIG. 4 are schematic illustrations showing a driving portion during initial unengagement in this embodiment, in which, (a) illustrates driving force transmission and (b) illustrates an engagement relation at the driving portion.

The supplying roller 24 in this embodiment is constituted so that the driving force is not transmitted only in the brand-new state (during initial drive). Specifically, as shown in (a) of FIG. 4, an engaging phase between the cut-away portion 24*a*1, indicated by a broken line, provided at the end portion of the electroconductive core metal 24*a* of the supplying roller 24 and the engaging hole 7*a* of the supplying roller driving gear 7 is shifted. Then, as shown in (b) of FIG. 4, while shifting the phase with respect to the rotational direction of the core metal 24*a* of the supplying roller, an inside edge surface of the supplying roller driving gear 7 is abutted against the end surface of the core metal 24. Thus, the supplying roller 24 and the supplying roller driving gear 7 are constituted so that the core metal 24*a* of the supplying roller 24 is not engaged with the engaging hole 7*a* of the supplying roller driving gear 7 until the core metal 24*a* is rotated at a predetermined angle.

Here, a distance corresponding to the shifted phase is required to be larger than a distance obtained by subtracting a distance of the contact nip between the supplying roller 24 and the developing roller 25 from a distance corresponding to at least one full circumference (360 degrees) of the supplying roller 24. In this embodiment, the distance of the contact nip between the developing roller 25 and the supplying roller 24 is about 5 mm. Further, an angle corresponding to this distance is at least about 40 degrees. For this reason, there is a need to provide a phase difference of about 35 mm in distance and of about 320 degrees or more in angle. That is, the phase is required to be at least an angle obtained by subtracting the angle corresponding to the contact nip between the developing roller 25 and the supplying roller 24 from the angle corresponding to the one full circumference of the supplying roller 24.

Based on this constitution, initial drive of the supplying roller 24 in a brand-new state of the image forming apparatus will be described. FIG. 5 is a schematic illustration showing drive in an initial stage in this embodiment.

First, with reference to FIG. 5, a constitution of the driving portion and its peripheral portion will be described. The supplying roller 24 contacts the developing roller 25. To the core metal 25*a* of the developing roller 25, a developing roller driving gear 10 (developer carrying member driving gear) is fixedly provided. Further, the developing roller 25 is rotationally driven by the driving force from the driving force inputting gear 8 engaged with the developing roller driving gear 10. Incidentally, the driving force of the driving force inputting gear 8 is supplied from a developing roller driving means M (driving device).

As shown in FIG. 5, the supplying roller driving gear 7 is pressed (urged) by a pressing (urging) member 11 such as a spring from the longitudinal outside toward the longitudinal center of the supplying roller 24. Therefore, in a state in which the core metal 24*a* and the supplying roller driving gear 7 are not engaged ((b) of FIG. 4), the driving force is transmitted from only the developing roller 25. In the case where the core metal 24*a* and the supplying roller driving gear 7 are not engaged, the supplying roller driving gear 7 is held at a position (stand-by position), where it is adjacent to the core metal 24*a* and does not transmit the driving force to the supplying roller 24, while being pressed by the pressing member 11.

In the state in which the core metal 24*a* and the supplying roller driving gear 7 are not engaged, a frictional force of the contact portion between the supplying roller 24 and the developing roller 25 constitutes the driving force, so that the supplying roller 24 is rotated by the rotation of the developing roller 25. Here, the supplying roller 24 is rotated by the rotation of the developing roller 25, whereby the supplying roller 24 is compressed in the neighborhood of Y in FIG. 2. As a result, the toner T excessively clogging the supplying roller 24 can be discharged into the developing container 21, so that the load exerted on the supplying roller 24 during drive is alleviated.

With reference to FIGS. 6 and 7, a state after the driving force is inputted into the supplying roller 24 will be described. Parts (a) and (b) of FIG. 6 are schematic illustrations showing a state of the driving portion during engagement in this embodiment, in which (a) illustrates driving force transmission, and (b) illustrates an engagement relation of the driving portion. FIG. 7 is a schematic illustration of the driving portion during engagement in this embodiment.

First, the driving force inputting gear 8 drives the developing roller 25, so that the supplying roller 24 is rotated by the rotation of the developing roller 25. Thereafter, during the rotation of the supplying roller 24 by the rotation of the developing roller 25, as shown in FIG. 6, the supplying roller 24 and the supplying roller driving gear 7 are in a state in which a cut-away shape of the cut-away portion 24*a*1 of the core metal 24*a* of the supplying roller 24 and a shape of the engaging hole 7*a* formed in the supplying roller driving gear 7 are in phase. Then, as shown in FIG. 7, the supplying roller driving gear 7 pressed by the pressing member 11 engages with the core metal 24*a*. Thus, a position where the supplying roller driving gear 7 engages with the supplying roller 24 is referred to as a driving position.

Further, by movement of the supplying roller driving gear 7 to the driving position, as shown in FIG. 7, the supplying roller driving gear 7 and the driving force inputting gear 8 engage with each other. By this engagement, the driving force from the driving force inputting gear 8 is transmitted to also the supplying roller 24.

Thus, in this embodiment, only when the developing device 5 is in the brand-new state, the supplying roller 24 is rotated by the rotation of the developing roller 25. As a result, at the contact portion between the developing roller 25 and the supplying roller 24, an excessive load is not exerted. In addition, the toner T in the supplying roller 24 can be discharged into the developing container 21.

In this embodiment, after the supplying roller driving gear 7 is engaged with the core metal 24*a*, the supplying roller driving gear 7 is engaged with the driving force inputting gear 8 to permit transmission of the driving force. However, the present invention is not limited thereto but a similar functional effect can be obtained also in a constitution in which the engage between the gear 7 and the core metal 24*a* and the engagement between the gears 7 and 8 are performed simultaneously.

Further, the method in which the supplying roller 24 is not driven in the brand-new state of the developing device 5 is described but the present invention is not limited thereto. That is, a similar functional effect can be obtained also in a constitution in which the developing roller 25 is, in place of the supplying roller 24, not driven in the brand-new state of the developing device 5 and is rotated by the rotation of the supplying roller 24.

Incidentally, in this embodiment, the developer is used as the toner but the present invention is not limited thereto. For example, the developer may also be a mixture of the toner and a carrier. Further, in this embodiment, the developing device 5 is constituted as the cartridge detachably mountable to the main assembly of the image forming apparatus but as shown in FIG. 8, the present invention is applicable to also a constitution in which a process cartridge 30 constituted by integrally assembling the photosensitive drum 1 and the process means including the developing device 5 is used as a cartridge detachably mountable to the main assembly of the image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 177405/2011 filed Aug. 15, 2011, which is hereby incorporated by reference.

What is claimed is:

1. A developing device comprising:

a developer carrying member, rotatable while carrying a developer, for supplying developer to an image bearing member;

a developer supplying member, which is provided with a foam layer at its surface and is rotatably in contact with said developer carrying member, for supplying the developer to said developer carrying member;

a first gear for transmitting a driving force to said developer supplying member; and a second gear for transmitting the driving force to said first gear; and an elastic member for pressing said first gear, wherein said first gear is movable between a first position where said first gear is positioned outside said second gear and is in non-contact with said second gear in a longitudinal direction of said developer supply member and a second position where said first gear engages with said second gear and receives the driving force from said second gear, wherein said developer supplying member includes a shaft provided with an engaging portion, and said first gear is provided with a hole engageable with said engaging portion, wherein before initial drive of said developer carrying member, said developer supplying member is disposed at an angle, where said engaging portion is prevented from entering the hole, to prevent movement of said first gear from the first position to the second position, and wherein during the initial drive of said developer carrying member, when said developer supplying member is rotated by a frictional force generated between said developer supplying member and said developer carrying member to assume a predetermined angle, said engaging portion is changed from a state in which said engaging portion cannot enter the hole to a state in which said engaging portion can enter the hole, and said first gear is moved from the first position to the second position by a pressing force of said elastic member while causing the engaging portion to enter the hole.

2. The developing device according to claim 1, wherein said engaging portion is a cut-away portion provided at an end portion of the shaft of said developer supplying member.

3. The developing device according to claim 1, wherein timing when said first gear is moved to the second position during the initial drive of said developer carrying member is after a rotation shaft of said developer supplying member is rotated by an angle which is not less than an angle obtained by subtracting an angle, corresponding to a nip between said developer carrying member and said developer supplying member, from 360 degrees.

4. The developing device according to claim 1, wherein said second gear is provided on said developer carrying member.

5. The developing device according to claim 1, wherein said developer carrying member and said developer supplying member are rotated in the same direction during development.

6. An image forming apparatus comprising:

the developing device according to claim 1, and a driving device for driving said first gear.

7. A process cartridge detachably mountable to a main assembly of an image forming apparatus, comprising:

an image bearing member for bearing an electrostatic latent image;

a developer carrying member, rotatable while carrying a developer, for supplying the developer to said image bearing member;

a developer supplying member, which is provided with a foam layer at its surface and is rotatably in contact with said developer carrying member, for supplying the developer to said developer carrying member;

a first gear for transmitting a driving force to said developer supplying member;

a second gear for transmitting the driving force to said first gear; and an elastic member for pressing said first gear, wherein said first gear is movable between a first position where said first gear is positioned outside said second gear and is in non-contact with said second gear in a longitudinal direction of said developer supply member and a second position where said first gear engages with said second gear and receives the driving force from said second gear, wherein said developer supplying member includes a shaft provided with an engaging portion, and said first gear is provided with a hole engageable with said engaging portion, wherein before initial drive of said developer carrying member, said developer supplying member is disposed at an angle, where said engaging portion is prevented from entering the hole, to prevent movement of said first gear from the first position to the second position, and wherein during the initial drive of said developer carrying member, when said developer supplying member is rotated by a frictional force generated between said developer supplying member and said developer carrying member to assume a predetermined angle, said engaging portion is changed from a state in which said engaging portion cannot enter the hole to a state in which said engaging portion can enter the hole, and said first gear is moved from the first position to the second position by a pressing force of said elastic member while causing said engaging portion to enter the hole.

8. The process cartridge according to claim 7, wherein said engaging portion is a cut-away portion provided at an end portion of the shaft of said developing member.

9. The process cartridge according to claim 7, wherein timing when said first gear is moved to the second position during the initial drive of said developer carrying member is after a rotation shaft of said developer supplying member is rotated by an angle which is not less than an angle obtained by subtracting an angle, corresponding to a nip between said developer carrying member and said developer supplying member, from 360 degrees.

10. The process cartridge according to claim 7, wherein said second gear is provided on said developer carrying member.

11. The process cartridge according to claim 7, wherein said developer carrying member and said developer supplying member are rotated in the same direction during development.

12. An image forming apparatus comprising:

the process cartridge according to claim 7, and a driving device for driving said first gear.

13. The developing device according to claim 1, wherein when said developer supplying member is rotated by receiving the driving force from said first gear, during the initial drive of said developer carrying member, said developer supplying member is rotated in an opposite direction to a rotational direction thereof when said developer supplying member is rotated by the frictional force generated between said developer supplying member and said developer carrying member.

14. The process cartridge according to claim 7, wherein when said developer supplying member is rotated by receiving the driving force from said first gear, during the initial drive of said developer carrying member, said developer supplying member is rotated in an opposite direction to a rotational direction thereof when said developer supplying member is rotated by the frictional force generated between said developer supplying member and said developer carrying member.

* * * * *